United States Patent [19]

Brockmeyer et al.

[11] Patent Number: 4,802,527

[45] Date of Patent: Feb. 7, 1989

[54] APPARATUS FOR CASTING MOLTEN METAL

[75] Inventors: Jerry W. Brockmeyer, Hendersonville, N.C.; Michael A. Cummings, Taylor, S.C.

[73] Assignee: Swiss Aluminum Ltd., Chippis, Switzerland

[21] Appl. No.: 121,634

[22] Filed: Nov. 16, 1987

[51] Int. Cl.[4] ..... B22C 9/08

[52] U.S. Cl. ..... 164/358; 164/363; 164/134; 210/232; 210/456; 210/510.1; 210/773; 249/109

[58] Field of Search ..... 164/134, 358, 363, 271, 164/DIG. 6; 75/68 R; 249/109, 110; 210/232, 281, 456, 510.1, 773, 774

[56] References Cited

U.S. PATENT DOCUMENTS

| | | | |
|---|---|---|---|
| 3,971,433 | 7/1976 | Duchenne | 164/363 |
| 4,413,813 | 11/1983 | Pryor | 210/281 |
| 4,713,180 | 12/1987 | Hofmann et al. | 210/773 |

FOREIGN PATENT DOCUMENTS

| | | | |
|---|---|---|---|
| 341583 | 7/1970 | U.S.S.R. | 249/109 |

*Primary Examiner*—Nicholas P. Godici
*Assistant Examiner*—Richard K. Seidel
*Attorney, Agent, or Firm*—Bachman & LaPointe

[57] ABSTRACT

Apparatus for casting molten metal including a mold for casting molten metal having a base portion, a molten metal inlet located at the base portion, a filter positioned across the molten metal inlet so that all the molten metal must pass therethrough and a well beneath said inlet and beneath said filter.

9 Claims, 3 Drawing Sheets

APPARATUS FOR CASTING MOLTEN METAL

BACKGROUND OF THE INVENTION

To improve the cleanliness of various alloys, especially various alloys such as steel, which are cast by bottom pouring methods, it is particularly useful to filter the metal through a ceramic foam filter. The effect of this filter is to remove particulate inclusions and, in some cases, liquid inclusions. Thus, the filtration procedure has a beneficial effect on the quality of the resultant metal ingots. A variety of molten metal filters are known in the art, such as described in U.S. Pat. No. 3,962,081.

Bottom pouring casting methods generally involve the use of a common sprue and a plurality of ingot molds and runners from the common sprue to the ingot molds. The filter may be placed in a small tundish between the ladle and the top of the sprue. Alternatively, there are advantages in placing the filter directly upstream of the ingot butt.

However, each of these procedures suffers from disadvantages. Placing the filter at the top of the sprue permits reoxidation of the melt downstream of the filter. Also, a large amount of metal flow must be accommodated by a filter at the top of the sprue since all metal for the plurality of ingot molds passes through the sprue.

As indicated above, placing the filter directly in the ingot butt offers advantages. This installation is relatively simple, allows minimum opportunity for reoxidation of the melt downstream of the filter and enables the use of a plurality of filters to accommodate each ingot individually with a resultant smaller total metal throughput through the filter than would be provided with a common filter at the top of the sprue. However, this method also has certain shortcomings. It can be difficult to prime the filter with the molten metal. There is little opportunity for preheating the filter. Also, the filter is subject to high mechanical stresses resulting in the possibility of breakage. For example, sprues are commonly 10 to 20 feet high and therefore a large metallostatic head is built up.

It is an object of the present invention to provide an apparatus for casting molten metal using a metal filter and using the bottom pour method.

It is a further object of the present invention to provide an apparatus as aforesaid which utilizes the filter directly upstream of the ingot butt.

It is a still further object of the present invention to provide an apparatus as aforesaid which enables convenient priming of the filter and which minimizes mechanical stresses resulting in the possibility of breakage.

It is a further object of the present invention to provide an apparatus as aforesaid which is simple, convenient and expeditious to use on a commercial scale.

Further objects and advantages of the present invention will appear hereinbelow.

SUMMARY OF THE INVENTION

It has now been found that the foregoing objects and advantages may be readily obtained in accordance with the present invention.

The apparatus of the present invention comprises: a mold for casting molten metal having a base portion; a molten metal inlet located at the base portion; a filter positioned across the molten metal inlet so that all molten metal must pass therethrough; and a well beneath said inlet and beneath said filter. Means are provided on the molten metal inlet to hold the filter in place. Preferably, said means comprises a support plate including an annular ring extending across the inlet above the filter, with at least one passageway therein for flow of molten metal therethrough, preferably with spaced passageways therein. Generally, a plurality of said molds are provided with a common sprue and with runners extending from the sprue to each mold.

The well generally has a volume of at least two times the volume of the filter and generally below ten times the volume of the filter.

A preferred embodiment includes a circumferential inlet molten metal channel for molten metal flow to said well to create a swirling action therein. In a further preferred embodiment a metal foil is provided beneath said filter having a lower melting point than said molten metal.

The present invention can readily be used with any molten metal, but finds particularly advantageous use with ferrous and nickel-based alloys.

It can be readily seen that the apparatus of the present invention is readily adaptable to existing systems without substantial redesign. Moreover, it can be seen that the apparatus of the present invention permits use of the filter directly upstream of the ingot butt with the resultant advantages thereof. The apparatus of the present invention permits a high degree of filtration, relatively simple installation and use, and substantial freedom from the problems of priming and mechanical stress. The incorporation of the well permits significant advantages. It has been found that as the molten metal first contacts the filter a metal skin is formed across the face of the filter. The well beneath the filter provides space to hold the molten metal in contact with the skin and to re-melt the skin.

Further advantages and features of the present invention will appear hereinbelow.

DETAILED DESCRIPTION

Figure 1:
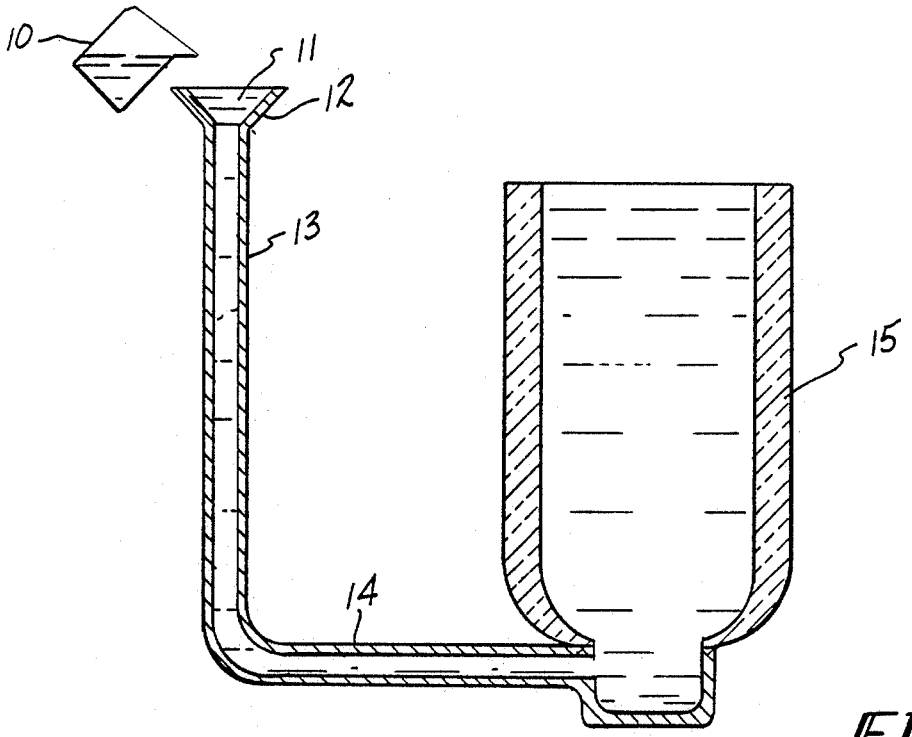
FIG. 1 is a partly schematic side view of a typical metal bottom pouring operation.
Figure 2:
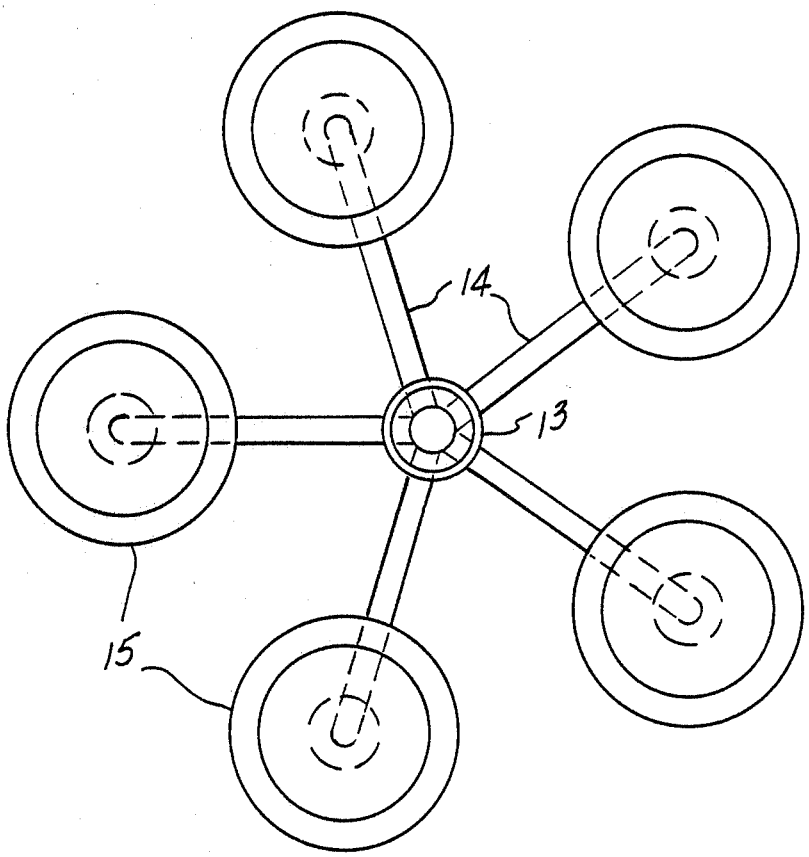
FIG. 2 is a schematic view showing a plurality of molds attached to a common sprue with runners from each mold to the sprue.
Figure 3:
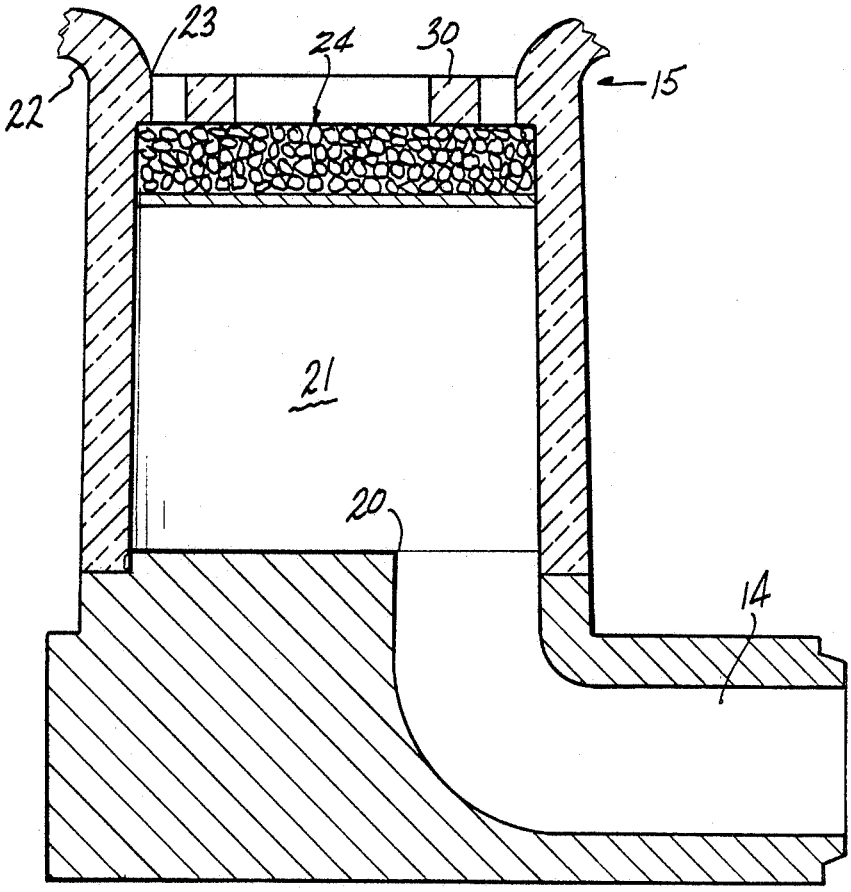
FIG. 3 is a sectional view showing details of a typical runner according to the present invention, well, and molten metal inlet to the mold.

A typical molten metal pouring operation is shown schematically in FIG. 1 wherein a source 10 of molten metal 11 is provided which may be top poured as shown, from the ladle bottom, or directly from the furnace. The molten metal source 10 is upstream of pouring cup 12 which is then used as a target for pouring and to provide a reservoir of molten metal transfer means or sprue 13 communicating directly with the pouring cup. The molten metal transfer means 13 may consist of a sprue or sprues which lead to one or more runners 14 that ultimately feed the casting or ingot mold 15. a plurality of said ingot molds 15 and runners 14 generally radiate from a common sprue 13. FIG. 3 shows five of said molds with five of said runners. Typically a plurality of said runners and molds are provided, as for example 4 to 8.

Figure 4:
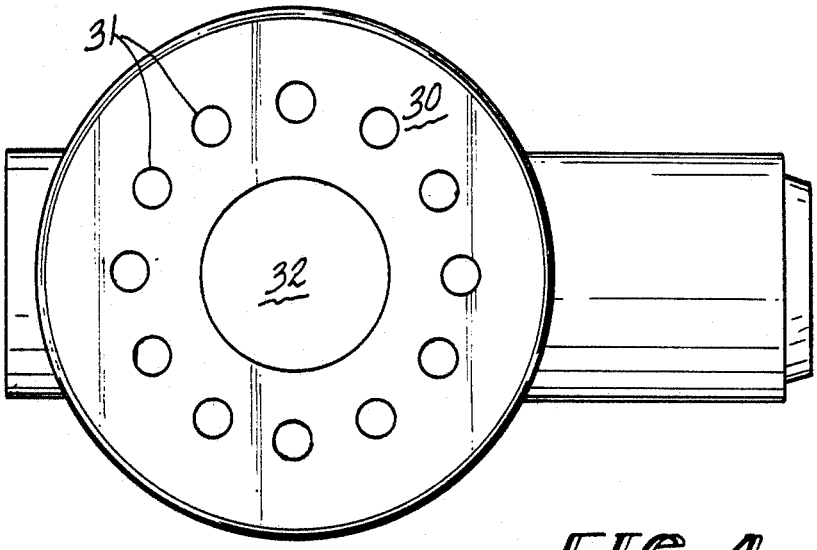
FIG. 4 is a top view showing a support plate for holding the filter in place.

FIG. 3 is an enlarged detailed view of one of said runners 14 leading directly to an ingot mold 15. As shown in FIG. 3, runner 14 leads to runner inlet 20 which in turn leads to well 21 directly downstream of runner inlet 20. Ingot mold 15 is provided with a base portion 22 and an ingot mold molten metal inlet 23 located at base portion 22. A filter 24 is secured in position across the molten metal inlet 23 so that all molten metal must pass therethrough. Filter 24 may be secured in place by cementing or by providing setting flanges with appropriate gaskets as necessary. Naturally, one must utilize a filter of sufficient strength to tolerate the adverse conditions. Also, the filter material must be resistant to the particular metal utilized in the particular operation. Although a wide variety of filters can readily be used, typical filters are described in the aforesaid U.S. Pat. No. 3,962,081 as well as in U.S. Pat. No. 4,610,832. Means 30 are preferably provided on said inlet 23 to hold the filter in place. In the preferred embodiment as clearly shown in FIG. 4 these means comprise a support plate including an annular ring extending across said inlet 23 with at least one passageway therein for the flow of molten metal therethrough, and preferably a plurality of said passageways 31. As shown in the embodiment of FIG. 4 a central passageway 32 is provided in said ring as well as passageways 31 extending circumferentially around central passageway 32. The support plate 30 is intended to prevent mechanical damage to the filter due to the large head. The use of the filter plate does not minimize the usage of the entire filter therebelow, but rather provides a support means to prevent damage.

Figure 5:
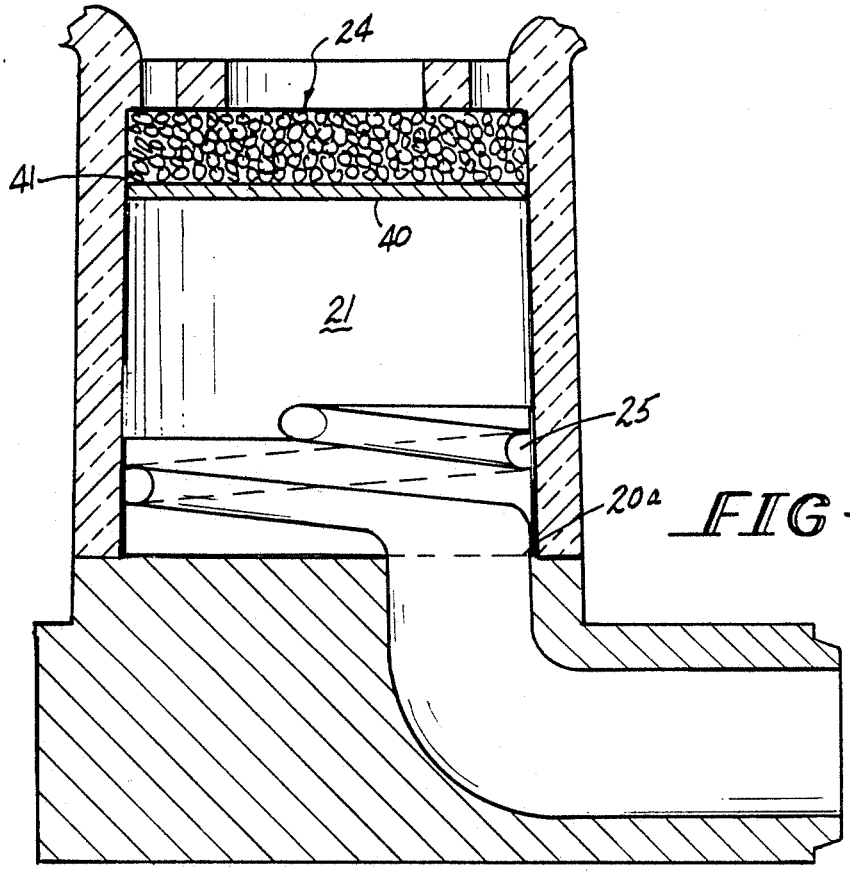
FIG. 5 is a view similar to FIG. 3 showing a circumferential molten metal inlet channel for metal flow to said well.

In a preferred embodiment, one can utilize a lower melting foil 40 affixed to the inlet face 41 of filter 24, as shown in FIG. 5. For example, when casting an iron base alloy containing nickel one can use a nickel alloy. The molten metal melts the foil and forms a lower melting alloy and facilitates priming.

Figure 6:
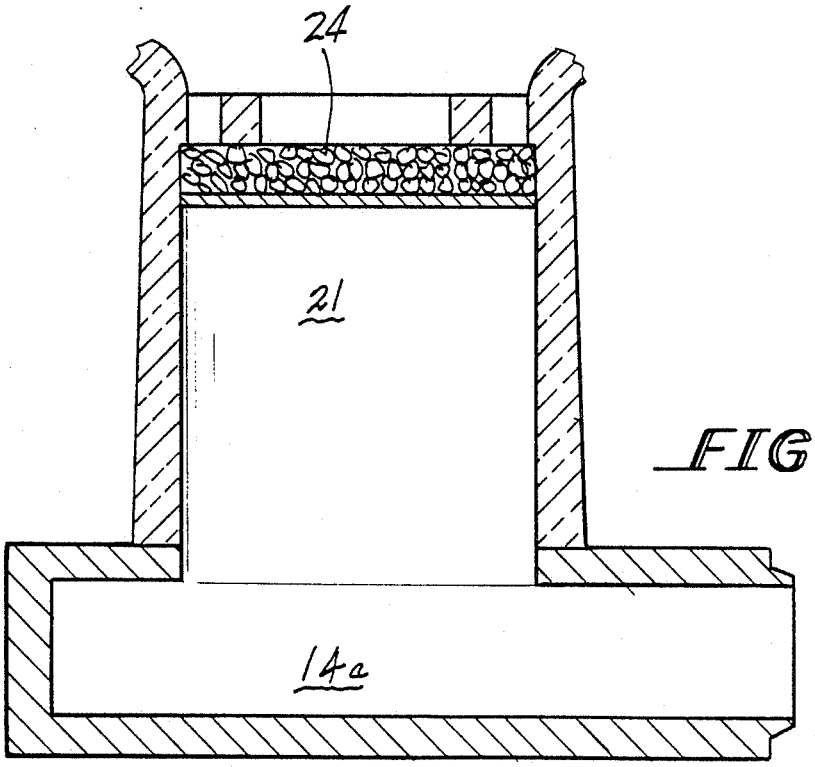
FIG. 6 is a view similar to FIG. 3 showing an alternate embodiment.

In another preferred embodiment as shown in FIG. 5 runner inlet **20*a* includes a circumferential channel 25 for metal flow to well 21 to create a swirling action. As a further alternative embodiment shown in FIG. 6, runner 14*a* can extend beneath and beyond well 21** in order to provide turbulence and a larger reservoir of molten metal beneath the filter.

Generally, well 21 should provide at least two times the volume of the filter. The upper limit of the volume of the well is not particularly critical; however, it is preferred that the volume of the well be below ten times the volume of the filter. In a typical application wells of from two to ten inches in depth may be conveniently used with filters one and one-half inches in depth.

The present invention will be more readily understandable from a consideration of the following illustrative examples.

In these example 304 stainless steel was cast into an ingot weighing approximately 6700 lbs. A single ingot was run through a common sprue and runner. The ingot size was 21 inches by 21 inches by 73 inches. The common sprue was 10 feet high and 4 inches in diameter. The runner was 2 feet long and 2 inches in diamter. An arrangement as shown in FIG. 5 was utilized with a 6 inch deep well and a 3 inch circumferential ramp beneath the well to create turbulence. The diameter of the well was 8 inches.

The filter placed at the top of the well and in the ingot molten metal inlet was 8 inches in diameter and was 1½ inches thick. The filter was a ceramic foam filter based on a zirconia-alumina ceramic having a pore size of approximately five pores per inch.

In this test the furnace was tapped at 2820° F. The filter took 15 seconds to prime, the ingot mold took 1 minute and 25 seconds to fill completely, equivalent to 1.675 pounds per square inch per second. The priming was rapid, the filling of the ingot was rapid and a good quality inclusion free ingot resulted.

In a comparative test without the filter the ingot had a tendency to retain inclusions and have a poorer quality. In addition, in comparative tests without the well but with the filter resulting in the filter having a tendency to suffer mechanical damage and the filter failing to prime.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for casting molten metal which comprises: a mold for casting molten metal having a base portion; a molten metal inlet located at the base portion; a horizontally disposed filter positioned across the molten metal inlet so that all molten metal must pass therethrough; an annular holding means disposed above said filter to hold said filter in place and to prevent mechanical damage to the filter; and a well beneath said inlet and beneath said filter.

2. An apparatus according to claim 1 including a plurality of said molds with a common sprue and runners extending from the sprue to each mold.

3. An apparatus according to claim 1 wherein the well has a volume at least two times the volume of the filter.

4. An apparatus according to claim 3 wherein said volume is below ten times the volume of the filter.

5. An apparatus according to claim 1 including a circumferential molten metal inlet channel adjacent said well for molten metal flow to said well to create a swirling action therein.

6. An apparatus according to claim 1 wherein said holding means is an annular support plate extending across said molten metal inlet.

7. An apparatus for casting molten metal which comprises: a mold for casting molten metal having a base portion; a molten metal inlet located at the base portion; a filter positioned across the molten metal inlet so that all molten metal must pass therethrough; means to hold said filter in place comprising a support plate including an annular ring extending across said molten metal inlet above said filter with at least one passageway therein for the flow of molten metal therethrough; and a well beneath said inlet and beneath said filter.

8. An apparatus according to claim 7 wherein said support plate includes spaced passageways therein.

9. An apparatus for casting molten metal which comprises: a mold for casting molten metal having a base portion; a molten metal inlet located at the base portion; a filter positioned across the molten metal inlet so that all molten metal must pass therethrough; a metal foil beneath said filter having a lower melting point than the molten metal being cast; and a well beneath said inlet and beneath said filter.

* * * * *